US008885317B2

(12) United States Patent
Partridge

(10) Patent No.: US 8,885,317 B2
(45) Date of Patent: Nov. 11, 2014

(54) MICROPULSE BIPOLAR CORONA IONIZER AND METHOD

(75) Inventor: Leslie Wayne Partridge, San Jose, CA (US)

(73) Assignee: Illinois Tool Works Inc., Glenview, IL (US)

( * ) Notice: Subject to any disclaimer, the term of this patent is extended or adjusted under 35 U.S.C. 154(b) by 644 days.

(21) Appl. No.: 13/023,397

(22) Filed: Feb. 8, 2011

(65) Prior Publication Data

US 2012/0200982 A1 Aug. 9, 2012

(51) Int. Cl.
*H01T 23/00* (2006.01)
*B03C 3/68* (2006.01)
*B03C 3/38* (2006.01)

(52) U.S. Cl.
CPC . *B03C 3/68* (2013.01); *H01T 23/00* (2013.01); *B03C 3/38* (2013.01)
USPC ..... 361/231

(58) Field of Classification Search
USPC ..... 361/231
See application file for complete search history.

(56) References Cited

U.S. PATENT DOCUMENTS

| | | | |
|---|---|---|---|
| 3,875,035 | A | 4/1975 | Lowther |
| 4,138,233 | A | 2/1979 | Masuda |
| 4,417,293 | A | 11/1983 | Larigaldie |
| 4,442,356 | A | 4/1984 | Ludwick et al. |
| 4,689,715 | A | 8/1987 | Halleck |
| 4,781,736 | A | 11/1988 | Cheney et al. |
| 4,878,149 | A | 10/1989 | Stiehl et al. |
| 4,901,194 | A | 2/1990 | Steinman et al. |
| 5,005,101 | A | 4/1991 | Gallagher |
| 5,047,892 | A | 9/1991 | Sakata et al. |
| 5,055,963 | A | 10/1991 | Partridge |
| 5,095,400 | A | 3/1992 | Saito |
| 5,116,583 | A | 5/1992 | Batchelder et al. |
| 5,249,094 | A | 9/1993 | Hayakawa et al. |
| 5,388,769 | A | 2/1995 | Rodrigo et al. |
| 5,447,763 | A | 9/1995 | Gehlke |
| 5,535,089 | A | 7/1996 | Ford et al. |

(Continued)

FOREIGN PATENT DOCUMENTS

| | | |
|---|---|---|
| EP | 0 386 318 A1 | 9/1990 |
| EP | 0386318 (A1) | 9/1990 |

(Continued)

OTHER PUBLICATIONS

Notice of Allowability mailed Dec. 1, 2005 for U.S. Appl. No. 10/821,773.

(Continued)

*Primary Examiner* — Jared Fureman
*Assistant Examiner* — Terrence Willoughby
(74) *Attorney, Agent, or Firm* — Stephen Uriarte

(57) ABSTRACT

A solution for static charge neutralization that includes providing at least one pulse train pair to an emitter of an ionizer is disclosed. The pulse train pair is disposed to include a positive pulse train and a negative pulse train that alternate in sequence. The positive pulse train includes an ionizing positive voltage waveform, while the negative pulse train includes an ionizing negative voltage waveform. These ionizing positive and negative voltage waveforms alternately create voltage gradients across the emitter and a reference electrode of the ionizer, generating by corona discharge an ion cloud that includes positive and negative ions.

20 Claims, 6 Drawing Sheets

(56) References Cited

U.S. PATENT DOCUMENTS

| | | | | |
|---|---|---|---|---|
| 5,550,703 | A | 8/1996 | Beyer et al. | |
| 5,630,949 | A | 5/1997 | Lakin | |
| 5,847,917 | A | 12/1998 | Suzuki | |
| 6,145,391 | A | 11/2000 | Pui et al. | |
| 6,330,146 | B1 | 12/2001 | Blitshteyn et al. | |
| 6,504,700 | B1 | 1/2003 | Hahne et al. | |
| 6,636,411 | B1 | 10/2003 | Noll | |
| 6,653,638 | B2 | 11/2003 | Fujii | |
| 6,671,161 | B2 | 12/2003 | Nilsson | |
| 6,693,788 | B1 | 2/2004 | Partridge | |
| 6,807,044 | B1 | 10/2004 | Vernitsky et al. | |
| 6,826,030 | B2 | 11/2004 | Gorczyca et al. | |
| 6,850,403 | B1 | 2/2005 | Gefter et al. | |
| 7,031,133 | B2 | 4/2006 | Riebel et al. | |
| 7,057,130 | B2 | 6/2006 | Gefter et al. | |
| 7,126,092 | B2 | 10/2006 | Lin et al. | |
| 7,177,133 | B2 | 2/2007 | Riskin | |
| 7,180,722 | B2 | 2/2007 | Jacobs et al. | |
| 7,339,778 | B1 | 3/2008 | Gefter et al. | |
| 7,375,944 | B2 | 5/2008 | Izaki et al. | |
| 7,479,615 | B2 | 1/2009 | Gefter et al. | |
| 7,649,728 | B2 | 1/2010 | Fujita et al. | |
| 7,679,026 | B1 | 3/2010 | Gefter et al. | |
| 7,751,695 | B2 | 7/2010 | Decker | |
| 7,813,102 | B2 | 10/2010 | Gefter et al. | |
| 7,821,762 | B2 | 10/2010 | Yasuoka et al. | |
| 7,822,355 | B2 | 10/2010 | Schlitz | |
| 8,009,405 | B2 | 8/2011 | Gefter et al. | |
| 8,038,775 | B2 | 10/2011 | Gefter | |
| 8,048,200 | B2 | 11/2011 | Gefter et al. | |
| 8,063,336 | B2 | 11/2011 | Gefter et al. | |
| 8,174,814 | B2 | 5/2012 | Yasuoka et al. | |
| 2002/0125423 | A1 | 9/2002 | Ebeling et al. | |
| 2003/0007307 | A1 | 1/2003 | Lee et al. | |
| 2003/0011957 | A1 | 1/2003 | Nilsson | |
| 2004/0130271 | A1 | 7/2004 | Sekoguchi et al. | |
| 2005/0052815 | A1 | 3/2005 | Fujiwara et al. | |
| 2005/0083633 | A1 | 4/2005 | Riebel et al. | |
| 2005/0225922 | A1 | 10/2005 | Gefter et al. | |
| 2005/0236375 | A1 | 10/2005 | Gefter et al. | |
| 2006/0018811 | A1 | 1/2006 | Taylor et al. | |
| 2006/0021508 | A1 | 2/2006 | Kwon et al. | |
| 2006/0071599 | A1 | 4/2006 | Curtis et al. | |
| 2006/0232908 | A1 | 10/2006 | Izumi et al. | |
| 2007/0279829 | A1 | 12/2007 | Gefter et al. | |
| 2008/0151465 | A1 | 6/2008 | Fujita et al. | |
| 2008/0199208 | A1 | 8/2008 | Schlitz | |
| 2008/0225460 | A1 * | 9/2008 | Gefter et al. | 361/213 |
| 2008/0232021 | A1 | 9/2008 | Gefter et al. | |
| 2009/0316325 | A1 | 12/2009 | Gefter | |
| 2011/0299214 | A1 | 12/2011 | Gefter et al. | |
| 2012/0200982 | A1 | 8/2012 | Partridge | |
| 2012/0224293 | A1 | 9/2012 | Partridge et al. | |

FOREIGN PATENT DOCUMENTS

| | | |
|---|---|---|
| EP | 0386318 (B1) | 7/1994 |
| EP | 1142455 | 11/2003 |
| EP | 1 547 693 A1 | 6/2005 |
| EP | 1 547 693 B1 | 5/2012 |
| JP | S63-143954 | 6/1988 |
| JP | 2005-328904 | 3/1989 |
| JP | H03-230499 | 3/1989 |
| JP | H0435958 (Y2) | 8/1992 |
| JP | 5047490 | 2/1993 |
| JP | H06-275366 | 9/1994 |
| JP | 7249497 | 9/1995 |
| JP | 2520311 (B2) | 7/1996 |
| JP | 10055896 | 2/1998 |
| JP | H10-156213 | 6/1998 |
| JP | 11273893 | 9/1999 |
| JP | 2000-058290 | 2/2000 |
| JP | 2000-133413 | 5/2000 |
| JP | 2001-085189 | 3/2001 |
| JP | 2002-025748 | 1/2002 |
| JP | 2002216994 | 9/2002 |
| JP | 3401702 (B2) | 4/2003 |
| JP | 3536560 (B2) | 6/2004 |
| JP | 2005-216539 | 8/2005 |
| JP | 2006-12520 | 1/2006 |
| JP | 2006-196378 | 7/2006 |
| JP | 2008-124035 (A) | 5/2008 |
| JP | 200939893 | 9/2009 |
| JP | 4465232 (B2) | 5/2010 |
| JP | 5046390 (B2) | 10/2012 |
| JP | I384905 | 2/2013 |
| TW | 200939893 | 9/2009 |
| WO | WO 00/38484 | 6/2000 |
| WO | WO 03100932 | 12/2003 |
| WO | WO 2005/102582 | 11/2005 |
| WO | WO 2008/115884 | 9/2008 |
| WO | WO 2013/103368 A1 | 7/2013 |

OTHER PUBLICATIONS

Office Action mailed Aug. 11, 2005 for U.S. Appl. No. 10/821,773.
Office Action mailed Mar. 10, 2005 for U.S. Appl. No. 10/821,773.
Search Report for Taiwan Invention Patent Application No. 101103565, dated Dec. 16, 2013.
Office Action mailed Nov. 21, 2012 for U.S. Appl. No. 13/210,267.
Office Action mailed Aug. 3, 2010 for U.S. Appl. No. 12/049,350.
Office Action mailed Jan. 4, 2011 for U.S. Appl. No. 12/049,350.
International Preliminary Report on Patentability and Written Opinion for PCT/US05/09093, Jul. 28, 2005.
International Search Report for PCT/US05/09093, Jul. 28, 2005.
Office Action (Advisory Action) mailed Apr. 11, 2013 for U.S. Appl. No. 13/210,267.
Office Action mailed Jan. 4, 2011 for U.S. Appl. No. 13/023,397.
PCT Application PCT/US2012/033278, Notification of Trans . . . , International Search Report and Written Opinion of the International Searching Authority, mailed Sep. 14, 2012.
PCT/US08/03488 International Search Report; ISA/US; Jun. 9, 2009.
Webpages from LIROS website, pages, date unknown, available online at http ://www.liroselectronic.com and http://www.liroselectronic.com/documents/NoStatic-2009_eng.pdf.
Notification of Transmittal of the ISR and the Written Opinion (mailed Feb. 19, 2013) for PCT/US2012/064045.
International Search Report and Written Opinion of the ISR (Feb. 19, 2013) for PCT/US2012/064045.
Notification of Transmittal of International Search Report and Written Opinion of the ISA, and International Search Report for PCT/US2008/03488 (Jun. 9, 2009).
International Preliminary Report on Patentability and Written Opinion of the ISA for PCT/US2008/03488 (Jun. 9, 2009).
Written Opinion of the ISA for PCT/US2008/03488 (Jun. 9, 2009).
International Preliminary Report on Patentability and Written Opinion of the ISA for PCT/US2012/024095 (Jul. 5, 2012).
International Search Report for PCT/US2012/024095 (Aug. 16, 2012).
Written Opinion of the ISA for PCT/US2012/024095 (Aug. 13, 2013).
Written Opinion of the ISA (Sep. 17, 2009), and International Search Report (mailed Sep. 25, 2008) for PCT/US2008/057262.
Office Action mailed on Aug. 2, 2012 for U.S. Appl. No. 13/210,267.
Office Action mailed Jun. 10, 2010 for U.S. Appl. No. 11/398,446.
International search report, international preliminary report on patentability, and written opinion mailed Jul. 23, 2008 for PCT application PCT/US2007/065767.
Office Action mailed Jan. 28, 2010 for U.S. Appl. No. 11/398,446.
Notice Allowance mailed Oct. 28, 2009 for U.S. Appl. No. 11/623,316.
Office Action mailed Jul. 22, 2009 for U.S. Appl. No. 11/623,316.
Office Action mailed Oct. 30, 2008 for U.S. Appl. No. 11/623,316.
Notice of Allowability mailed Sep. 22, 2008 for U.S. Appl. No. 11/136,754.
Office Action mailed Apr. 30, 2008 for U.S. Appl. No. 11/136,754.
Office Action mailed Jun. 1, 2007 for U.S. Appl. No. 11/136,754.

(56) References Cited

OTHER PUBLICATIONS

Office Action mailed Mar. 28, 2007 for U.S. Appl. No. 11/136,754.
Notice of Allowability mailed Jul. 12, 2011 for U.S. Appl. No. 11/398,446.
Interview Summary mailed Mar. 9, 2011 for U.S. Appl. No. 11/398,446.
Office Action mailed Dec. 13, 2010 for U.S. Appl. No. 11/398,446.
Office Action mailed Dec. 7, 2011 for U.S. Appl. No. 12/456,526.
Office Action mailed Jul. 5, 2012 for U.S. Appl. No. 12/456,526.
Applicant-initiated Interview summary mailed Oct. 5, 2012 for U.S. Appl. No. 12/456,526.
Advisory Action mailed Oct. 5, 2012 for U.S. Appl. No. 12/456,526.
Notice of allowability mailed Dec. 16, 2013 for U.S. Appl. No. 13/367,369.
Office Action mailed Jun. 12, 2013 for U.S. Appl. No. 13/367,369.
Office Action mailed Feb. 2, 2013 for U.S. Appl. No. 13/367,369.
Office Action for U.S. Appl. No. 12/456,526, mailed on Mar. 11, 2014.
Notification of transmittal of the Int'l Search Report and the written opinion of the ISA, & ISR & Written Opinion of ISA (mailed May 7, 2012) for PCT/US2012/024095.
Notice of Allowance for U.S. Appl. No. 13/367,369, mailed on May 9, 2014.
Notice of Allowance for U.S. Appl. No. 12/075,967, mailed on Aug. 16, 2010.
Notice of Allowance for U.S. Appl. No. 12/075,967, mailed on Jun. 3, 2010.
Notice of Allowance for U.S. Appl. No. 12/075,967, mailed on Mar. 9, 2010.

* cited by examiner

FIG. 1
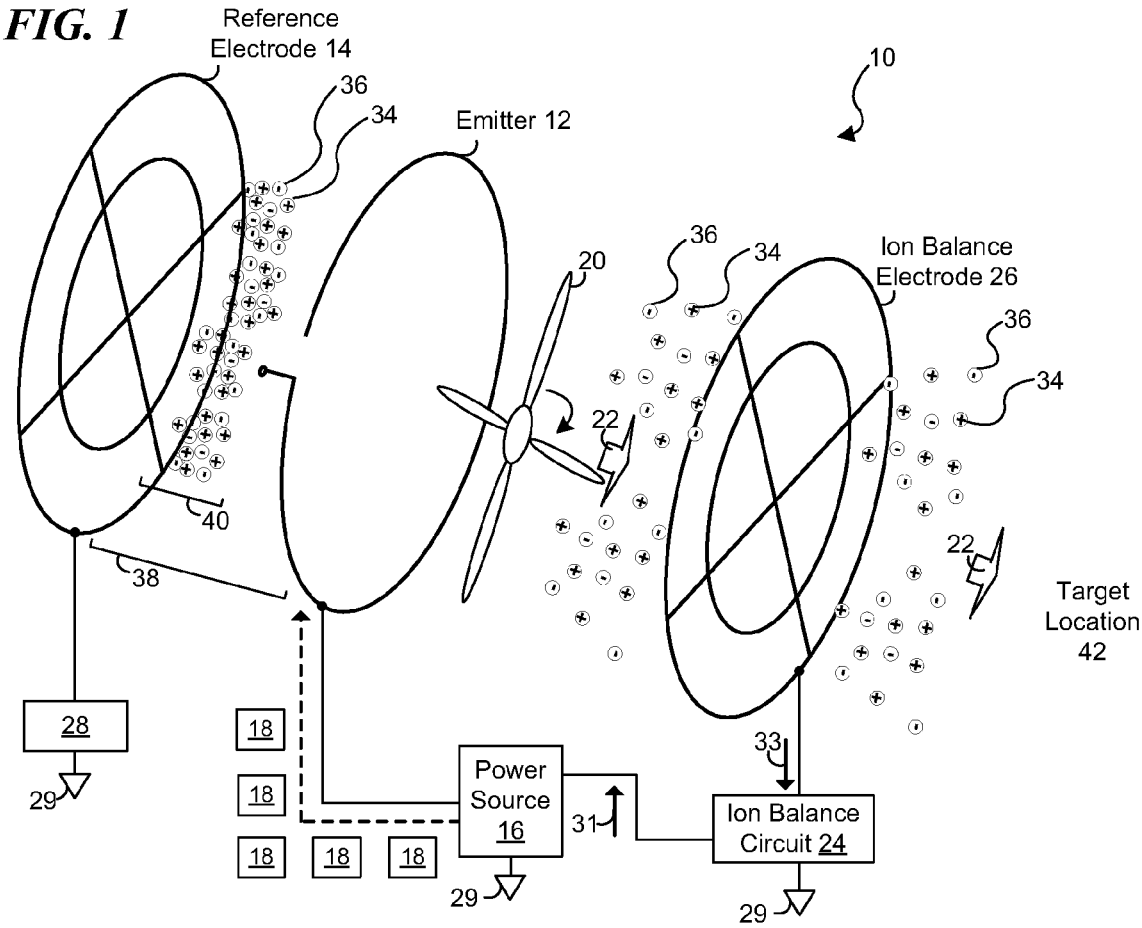
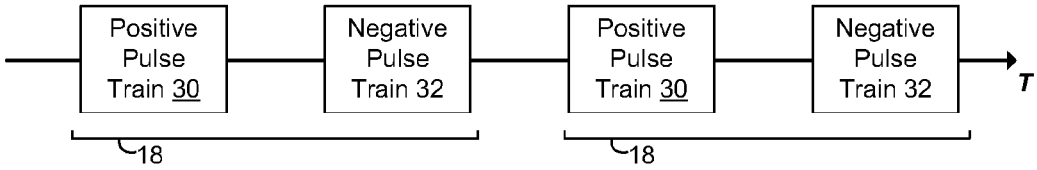
FIG. 3A
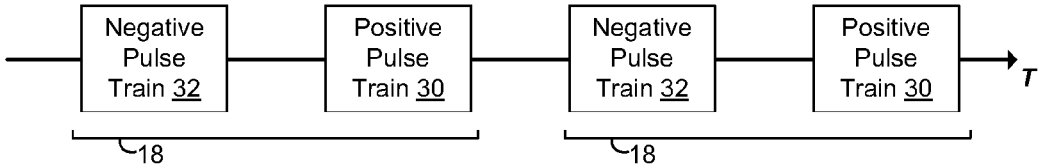
FIG. 3B

Magnified Oscillator Screenshot of a Positive Pulse Train

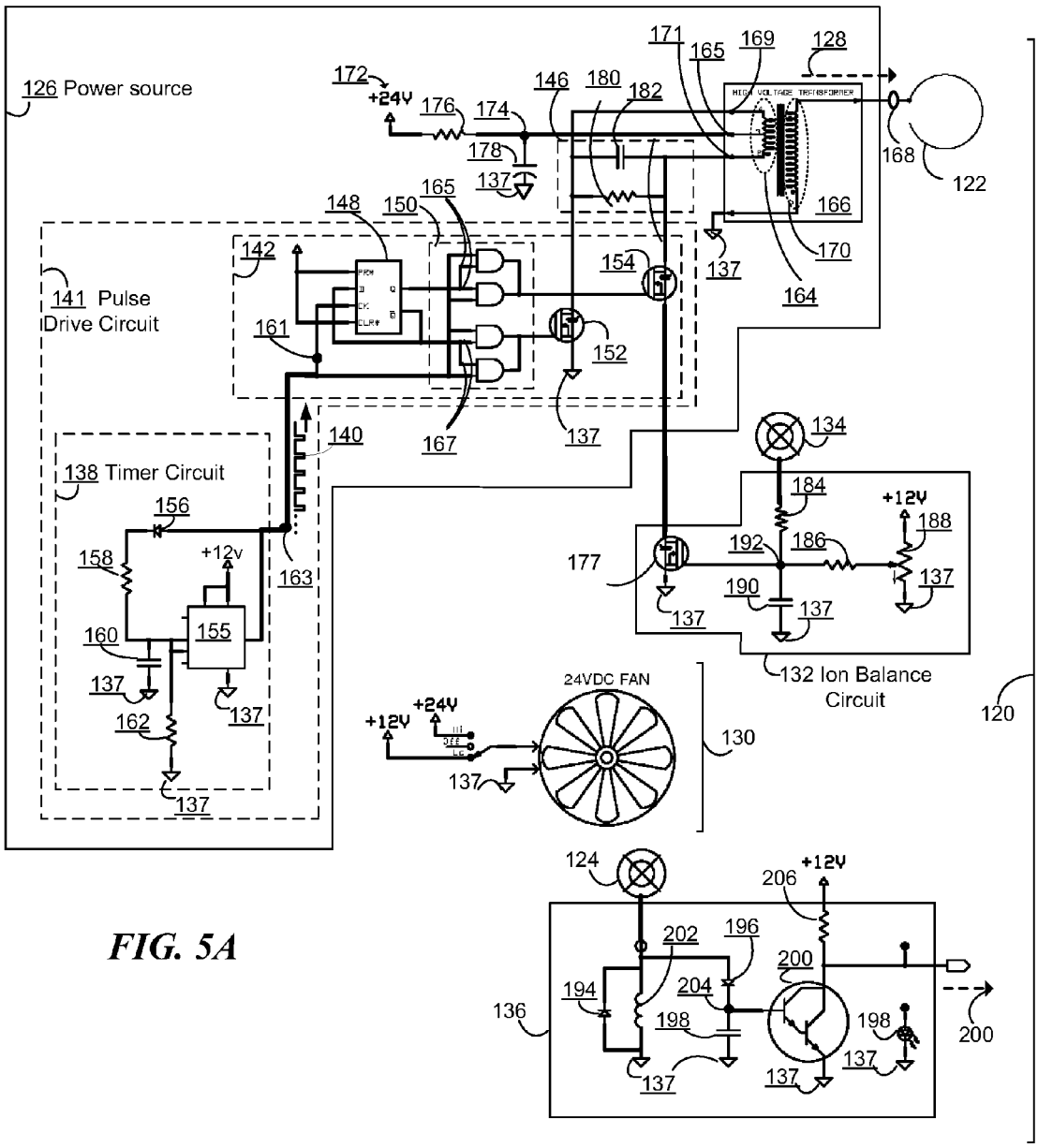
FIG. 5A
FIG. 5B
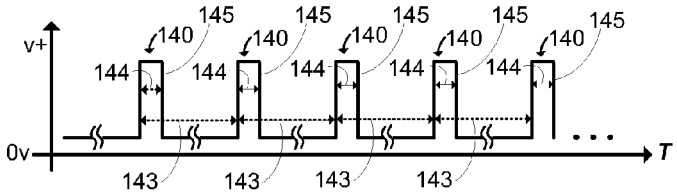

MICROPULSE BIPOLAR CORONA IONIZER AND METHOD

FIELD OF INVENTION

The present invention relates to a micro-pulse bipolar corona ionizer for reducing or neutralizing positive and negative static charges on charged object. More particularly, the present invention relates to a micro-pulse bipolar corona ionizer that has an ion balance control circuit; a spark surge suppressor and corona activity circuit; a relatively low rate of emitter contamination; a relatively low corona-byproducts emission, such as ozone, nitrogen oxides and the like; or any combination of these features.

BACKGROUND

AC corona ionizers are commonly used for static charge neutralization of charged objects. These ionizers, however, are prone to relatively high corona-byproducts emission, such as ozone and nitrogen oxides emissions in air, and a high rate of emitter contamination from the ambient environment. Emitter contamination decreases ionization efficiency and may affect ion balance, while ozone is a known health hazard. Consequently, a need exists for a solution for static charge neutralization that has a relatively low rate of emitter contamination, a relatively low ozone emission, ion balance control, or any combination of the foregoing.

SUMMARY

In accordance with one embodiment of the present invention, a solution for static charge neutralization that includes providing at least one pulse train pair to an emitter of an ionizer is disclosed. The pulse train pair is disposed to include a positive pulse train and a negative pulse train that alternate in sequence. The positive pulse train includes an ionizing positive voltage waveform, while the negative pulse train includes an ionizing negative voltage waveform. These ionizing positive and negative voltage waveforms alternately create voltage gradients across the emitter and a reference electrode of the ionizer, generating by corona discharge an ion cloud that includes positive and negative ions.

Various alternative embodiments of the present invention are also disclosed, including an ion balance control circuit, a spark surge suppressor and corona activity circuit, or any combination of these circuits.

BRIEF DESCRIPTION OF DRAWINGS

FIG. 1 is a simplified exploded perspective view of a micropulse bipolar corona ionizer in accordance with one embodiment of the present invention;

FIG. 3A depicts in block diagram form the sequence of positive and negative pulse trains that comprise an pulse train pair over time (T) in accordance with the embodiment of the present invention;

FIG. 3B depicts in block diagram form the sequence of negative and positive pulse trains that comprise an pulse train a pair over time (T) in accordance with an alternative embodiment of the present invention;

FIG. 5A is a circuit diagram of an micro-pulse bipolar corona ionizer in accordance with yet another embodiment of the present invention;

FIG. 5B is an example expanded view of the pulses shown in FIG. 5A;

DETAILED DESCRIPTION OF THE INVENTION

Figure 2:
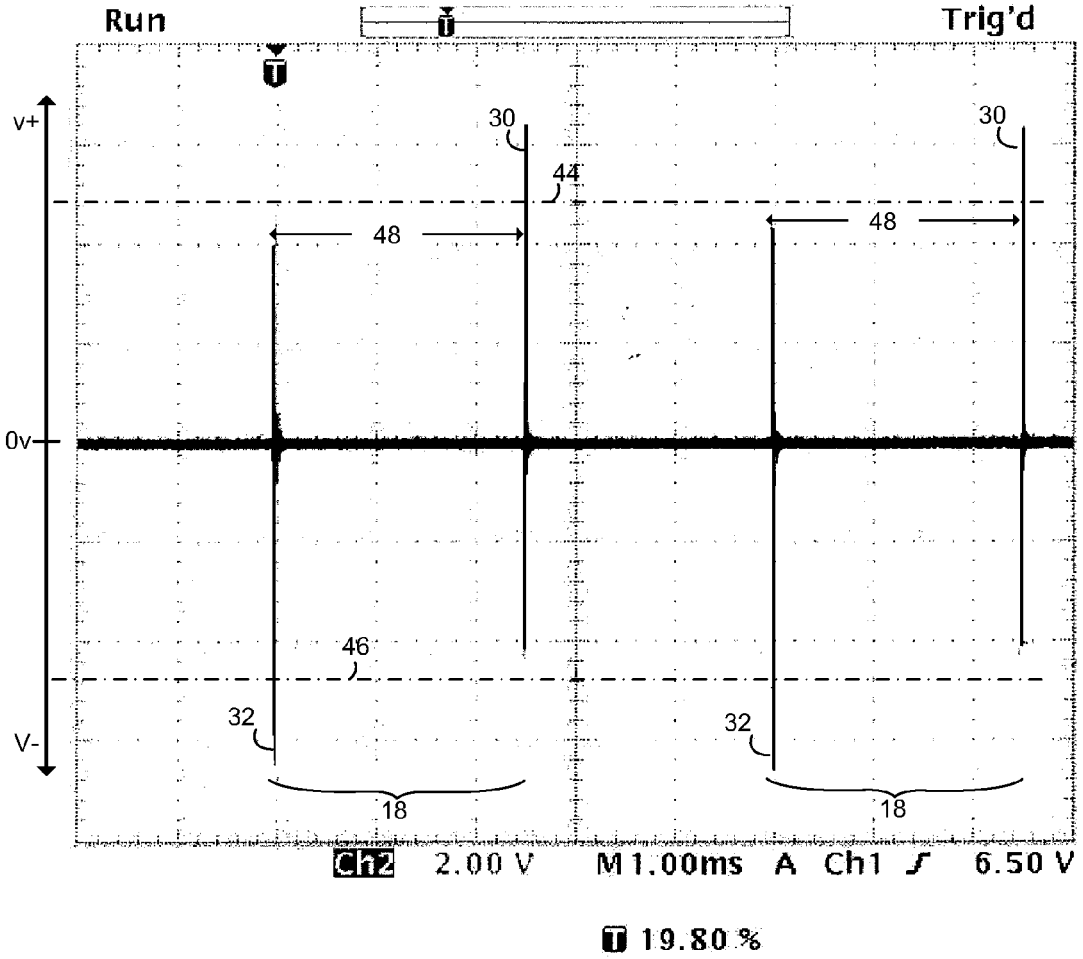
FIG. 2 is an oscillator screen shot of a series of pulse train pairs with each pulse train pair including a positive pulse train and a negative pulse train in accordance with yet another embodiment of the present invention.

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual implementation, numerous implementation-specific decisions may be required to achieve specific design objectives. These design objectives will vary from one implementation to another and from one developer to another. Moreover, it will be appreciated that such a development effort might be complex and time-consuming but would nevertheless be a routine engineering undertaking for those of ordinary skill in the art having the benefit of this disclosure.

FIG. 1 discloses a micro-pulse bipolar corona ionizer 10 that uses an ionizing electrode, named emitter 12; a conductive element or structure used as a reference electrode 14; a power supply 16 that is disposed to provide at least one voltage-alternating pulse train pair 18 to emitter 12; a gas source 20 disposed to provide a flow of gas 22; an ion balance circuit 24 that is electrically coupled to another electrode 26, named ion balance electrode, and to a common reference bus 29, such as ground; and a spark surge suppressor and corona activity circuit 28 coupled to reference electrode 14 and to common reference bus 29. Power supply 16 is electrically coupled to common reference bus 29, to reference electrode 14 through common reference bus 29, and to emitter 12. Pulse train pair 18 is received by emitter 12 and by reference electrode 14 through common reference bus 29.

As seen in FIG. 2, pulse train pair 18 includes positive and negative pulse trains 30 and 32 that alternate in serial sequence. An upper dashed line 44 represents a positive corona threshold voltage, such as 4.5 kV, and a lower dashed line 46 represents a negative corona threshold voltage, such as (−)4.25 kV. Each positive pulse train 30 is disposed to include an ionizing positive voltage waveform that has a maximum positive voltage amplitude which exceeds the voltage threshold for creating positive ions by corona discharge. Similarly, negative pulse train 32 is disposed to include an ionizing negative voltage waveform that has a maximum negative voltage amplitude which exceeds the voltage threshold for creating negative ions by corona discharge. Thus, these respective positive and ionizing negative voltage waveforms alternatively create voltage gradients across a space 38 between emitter 12 and reference electrode 14, generating by corona discharge an ion cloud that includes positive 34 and negative ions 36.

Using a serial sequence of pulse train pairs that each use positive and negative pulse trains provides efficient bipolar ionization for at least one emitter electrode. The number of pulse train pairs may be adjusted to maximize static charge neutralization or discharge of a target object, depending on the flow rate of gas blown or provided across an emitter, such as gas flow 22 and emitter 12 in FIG. 1. The repetition rate for each pulse train 18 is not intended to be limiting in any way. The repetition rate can be adjusted accordingly to the power level desired for the embodiment disclosed in FIG. 2 can be set from one to several thousand times per second with a duty factor from 0.1% to 1%. The term duty factor may also be referred to herein as the effective ratio of pulse train power on versus pulse train power off per pulse train time period, such as pulse train time period 48. Using a duty factor from 0.1% to 1% creates a very brief corona discharge, reducing ozone emissions as well as the rate of emitter contamination. The various embodiments of the present invention disclosed herein produces ozone emissions of concentrations of around 10 to 15 parts per billion (ppb), which is three to five times less than other types of known ionizers that use high frequency high-voltage alternating current to generate ions by corona discharge. The various embodiments disclosed herein also greatly reduce the rate of particle attraction to ionizer emitter(s), which in turn, reduces the rate of contamination of the emitter(s).

The alternating serial order of positive and negative pulse trains 30 and 32 in pulse train pair 18 is not intended to be limiting in any way. For example, in FIG. 3A, pulse train 18 is disposed to include a positive pulse 30 train followed by a negative pulse train 32 in an alternating serial sequence. Alternately, as shown in FIG. 3B, pulse train 18 may be disposed to include negative pulse train 32 followed by positive pulse train 30 in an alternating serial sequence. Positive and negative ions 34 and 36 may be also referred to collectively herein as a bipolar ion cloud 40. A corona ionizer that uses pulse train pairs to generate a bipolar ion cloud may be referred to herein as a micro-pulse bipolar corona ionizer 10.

Emitter 12 may be formed from a loop of conducting wire but the use of a loop of emitter wire is not intended to be limiting in any way. Any emitter shape, such as a pointed electrode or other equivalents (not shown), may be used as alternatives. Emitter 12 may be made from any type of electrode material that can conduct electricity in a manner required to support the features described herein, including the creation of ions by corona discharge. Thus, emitter 12 may be made from a combination variety of materials, some of which may not be purely conductive, such as semiconductor, insulating or any combination of these materials.

Reference electrode 14 is implemented in the form of a conducting fan guard but the use of this structure is not intended to be limiting. For instance, a separate non-conducting or conducting fan guard may be used in combination with a separately formed reference electrode. Similarly, ion balance electrode 26 is implemented by using a conducting fan guard but the use of such a structure is not intended to be limiting. As an alternative embodiment (not illustrated), a separate fan guard may be used in combination with ion balance electrode 26. Ion balance electrode 26 may be implemented by using any electrode that has a electrically conductive or semi-conductive surface, and may be placed at a location where bipolar ion cloud 40 will pass through, such as a location between target location 42 and the location where bipolar ion cloud 40 is created by the corona discharge. Bipolar ion cloud 40 is created by corona discharge generally within space 38 for the particular embodiment shown in FIG. 1. Positive and negative pulse trains 30 and 32 may be referred to in the alternative as positive and negative micro-pulses, respectively.

Gas source 20 may be used to enhance the mixing of positive and negative ions 34 and 36, to enhance the range of delivery of positive and negative ions 34 and 36 to a selected target object (not shown) located at target location 42 to increase bipolar ion cloud density at target location 42, or both. Gas source 20 in the embodiment shown is of a blower type, and employs a rotating fan to move air or gas through emitter 12, reference electrode 14 and ion balance electrode 26, such as gas flow 22. The use, type, and placement location of gas source 20, moreover, are not intended to limit the scope and spirit of this disclosure in any way. For instance, as alternative embodiments and not illustrated in FIG. 1, gas source 20 may be omitted, or if used, placed before emitter 12 so that gas or air may be blown or forced first through emitter 12 and then through reference electrode 14 and aimed towards a target location 42.

Further, a fan-type gas source may be used as shown, or in alternative embodiments, compressed gas or air may be provided through a pipe, duct, plenum, or nozzle, a group of nozzles arranged on an ionizing bar, a nozzle surrounding at least a portion of an emitter, or the like (not shown). In addition, the configuration of gas flow 22 may be air, nitrogen, other gases, or any combination of these gases that is suitable for bipolar ion cloud delivery to target area 42. Ion balance circuit 24 and ion balance electrode 26 may be used to balance ion current produced during the creation of bipolar ion cloud 40 by corona discharge. Ion balance circuit 24 is coupled to ion balance electrode 26, common reference bus 29, and power supply 16. Ion balance circuit 24 generates a signal 31 that is received and used by power supply 16 to adjust the balance of positive and negative electrodes generated by pulse train pair 18. Ion balance circuit 24 generates signal 31 by measuring the voltage 33 derived from positive and negative ions flowing past ion balance electrode 26 during operation. If voltage 33 is positive, ion balance circuit 24 adjusts signal 31 so that signal 31 causes power supply 16 to generate at least one pulse train pair, such as pulse train pair 18, that creates more negative ions than positive ions. Similarly, if voltage 33 is negative, power supply 16 generates at least one pulse train pair that creates more positive ions than negative ions. Spark surge suppressor and corona activity circuit 28 is coupled to reference electrode 14 and common reference bus 29 and shunts a current (not shown) that can arise when a spark of voltage occurs between reference electrode 26 and common reference bus 29. Spark surge suppressor and corona activity circuit 28 also provides a visual indicator that blinks in proportion to the amount of ions generated by micro-pulse bipolar corona ionizer 10.

In yet another alternative embodiment, which is not illustrated in FIG. 1 to avoid over-complicating this disclosure, spark surge suppressor and corona activity circuit 28, ion balance circuit 24 and ion balance electrode 26, or both may be eliminated from the embodiment shown in FIG. 1. In another alternative embodiment (not shown), reference electrode 14 may be directly coupled to common reference bus 29.

Figure 4A:
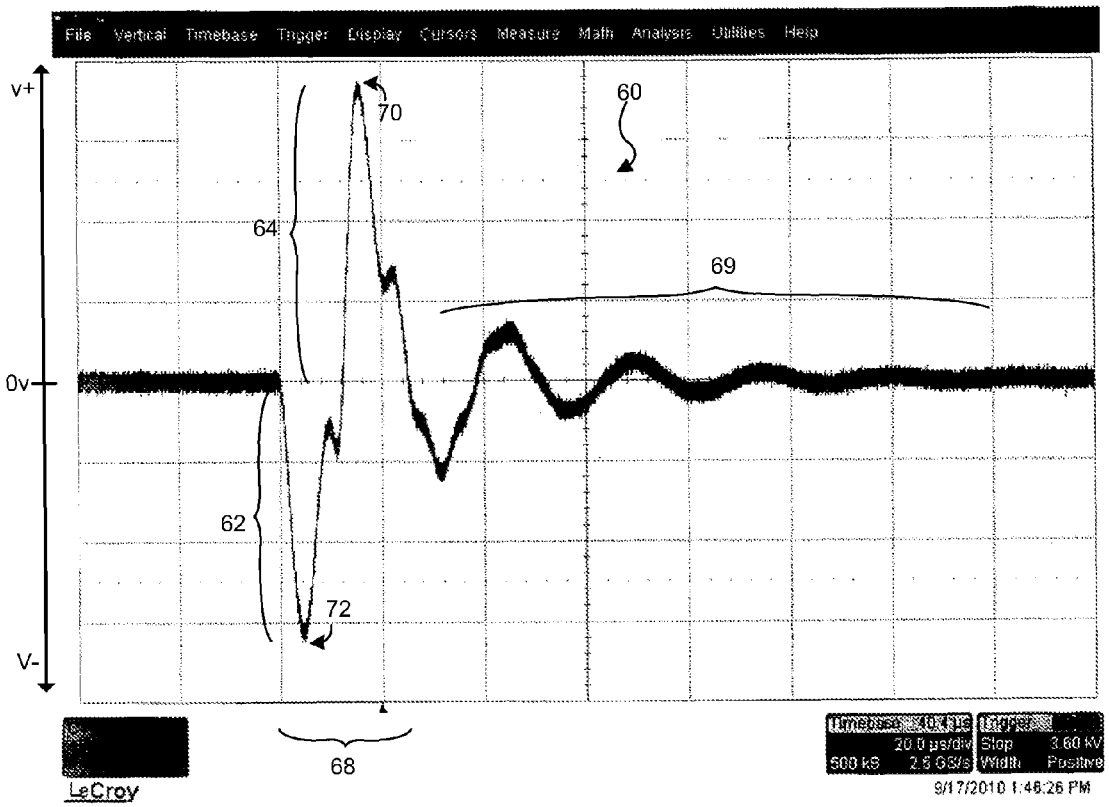
FIG. 4A is an oscillator screen shot of a positive pulse train that forms one portion of an pulse train pair in accordance with another embodiment of the present invention.

FIG. 4A is an oscillator screen shot of a positive pulse train 60 that forms one portion of an pulse train pair in accordance with another embodiment of the present invention. Pulse train pair 18 previously disclosed above with reference to FIGS. 2 and 3A 3B, may be disposed to include a pulse train 60, which includes two asymmetrical voltage waveforms, such as non-ionizing voltage waveform 62, and ionizing voltage waveform 64, which occur serially over a time period 68. Non-ionizing and ionizing voltage waveforms 62 and 64 are followed by smaller negative and positive oscillations 69. Negative and positive oscillations 69 are due to circuit resonance of the power supply used to generate pulse train 60 and are not intended to limit the present invention in anyway. Oscillations 69 may be completely reduced or eliminated by the use of a damping circuit as further disclosed below in FIG. 5A.

At least one of the asymmetrical voltage waveforms, such as ionizing voltage waveform 64, has a maximum voltage amplitude 70 that exceeds the corona discharge voltage threshold necessary to create ions within a space between an emitter and reference electrode of a micro-pulse bipolar corona ionizer, such as space 38, emitter 12 and reference electrode 14, and ionizer 10 respectively disclosed above with FIG. 1. These ions created by ionizing voltage waveform 64 have the same polarity as the voltage used by ionizing voltage waveform 64, which in the example shown is a positive polarity. An ionizing voltage waveform that creates positive ions may be also referred to herein as an "ionizing positive voltage waveform", such as ionizing voltage waveform 64. The term "asymmetrical voltage waveforms" describes the voltage modulation profile of sequential waveforms that alternate in polarity and that have different maximum voltage amplitudes with one of the maximum voltage amplitudes exceeding the corona threshold necessary to create ions by corona discharge. For example, a maximum amplitude 72 of non-ionizing voltage waveform 62 has a polarity (negative) that is opposite of the polarity (positive) of maximum amplitude 70 of ionizing waveform 64. Non-ionizing voltage waveform 62 in the embodiment shown occurs before ionizing voltage waveform 64 and has a maximum amplitude 72 that is not sufficient to create ions by corona discharge. A non-ionizing voltage waveform that has a negative maximum voltage amplitude that is insufficient to create negative ions by corona discharge may be also referred to herein as a "non-ionizing negative voltage waveform", such as non-ionizing voltage waveform 62.

A pulse train, such as pulse train 60 in FIG. 4A, that includes an ionizing positive voltage waveform, which is a waveform that has a positive maximum voltage amplitude which exceeds the corona discharge voltage threshold necessary for creating positive ions, such as ionizing waveform 64, is named herein as a "positive pulse train". Similarly a pulse train, such as pulse train 80 in FIG. 3B, that includes a ionizing negative voltage waveform, which is a waveform that has a negative maximum voltage amplitude that exceeds the corona discharge voltage threshold necessary for creating negative ions, such as ionizing waveform 84 in FIG. 3B, is named herein as a "negative pulse train". The sequence order of positive and negative pulse trains 60 and 80 in a voltage-alternating pulse train pair, such as pulse train pair 18 in FIG. 3A or FIG. 3B, is not intended to be limiting in any way. For example, in FIG. 3B, pulse train pair 18 has a pulse train sequence that starts with negative pulse train 32 followed by positive pulse train 30.

Using asymmetric voltage waveforms provides an efficient method for generating ions. The bipolar ion cloud oscillates in an area near emitter 12 that can be easily moved by an applied force, such as a gas flow or a superimposed electrical field. Because the period of ion generation is extremely short, corona byproduct emissions, such as ozone and nitrogen oxides is minimized and the rate of contamination on emitter 12 reduced.

Figure 4B:
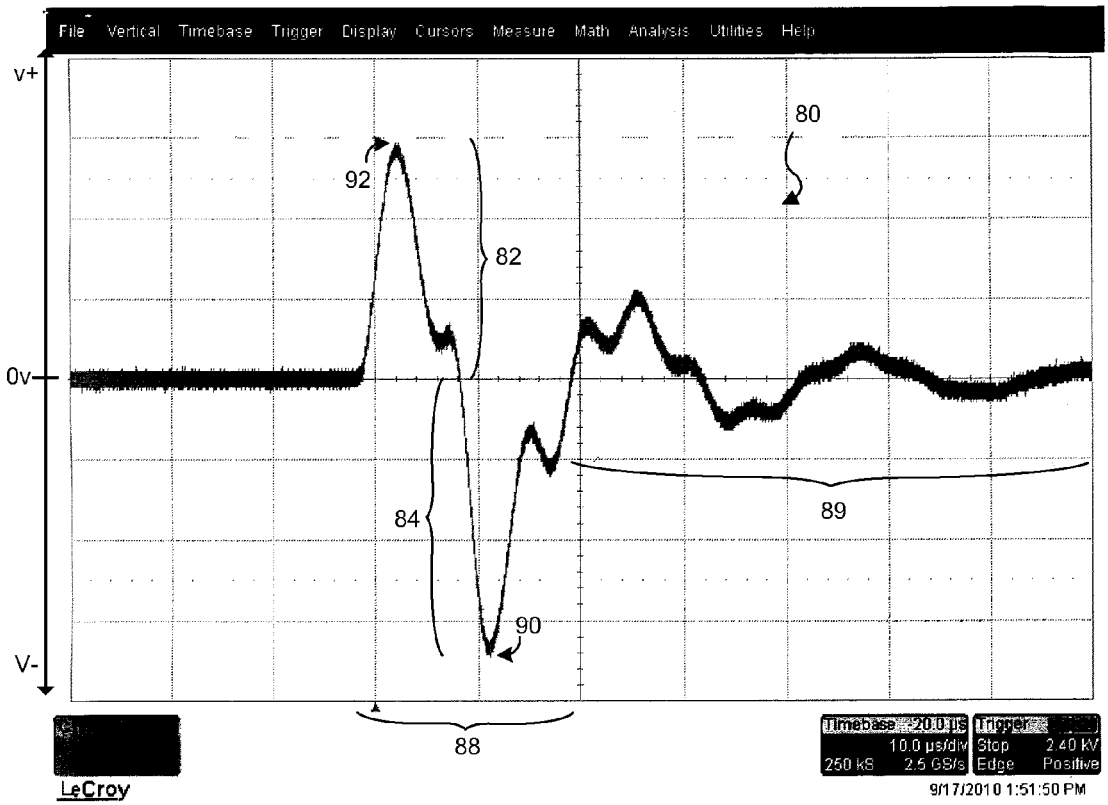
FIG. 4B is an oscillator screen shot of a negative pulse train that forms one portion of an pulse train pair in accordance with yet another embodiment of the present invention.

Like pulse train 60 in FIG. 4A, pulse train 80 in FIG. 4B is disposed to include two asymmetrical voltage waveforms, such as non-ionizing voltage waveform 82 and, ionizing voltage waveform 84, which occur in sequence over a time period 88. At least one of the asymmetrical voltage waveforms, such as ionizing voltage waveform 84, has a maximum voltage amplitude 90 that exceeds the corona discharge voltage threshold necessary to create ions within a space between an emitter and reference electrode of a micro-pulse bipolar corona ionizer, such as space 38, emitter 14 and reference and micro-pulse bipolar corona ionizer 10 respectively disclosed above in FIG. 1.

Non-ionizing and ionizing voltage waveforms 82 and 84 are followed by smaller negative and positive oscillations 89. Negative and positive oscillations 89 are created by the circuit resonance of the power supply used to generate pulse train 80 and are not intended to limit the present invention in anyway, and may be reduced or eliminated. Ions created by ionizing voltage waveform 84 have the same polarity as the voltage used by ionizing voltage waveform 84, which in the example shown is a negative polarity. The maximum amplitude 92 of non-ionizing voltage waveform 82 has a polarity (positive) that is opposite of the polarity (negative) of maximum amplitude 90 of ionizing voltage waveform 84. Maximum amplitude 92 of non-ionizing voltage waveform 82 is not sufficient to create ions by corona discharge. Ionizing voltage waveform 84 may be also referred to herein as an "ionizing negative voltage waveform" because it can create negative ions by corona discharge. Non-ionizing waveform 82, however, may be referred to herein as a "non-ionizing positive voltage waveform" because it has a positive maximum voltage amplitude that is insufficient to create positive ions by corona discharge.

Depending on the configuration of the power supply used, a non-ionizing voltage waveform, such as non-ionizing voltage waveform 62 or 82, has rise and fall slew rates that are less than the rise and fall slew rates of the following ionizing waveform, such as ionizing waveform 64 or 84 corresponding to the same pulse train pair. In accordance with one embodiment of the present invention, a non-ionizing voltage waveform may be disposed to have a period of between 1 microsecond and 24 microseconds, and rise and fall slew rates that each range from 100 to 1000 Volts per microsecond. An ionizing voltage waveform, such as ionizing voltage waveform 64 or 84, has rise and fall slew rates that are each approximately 1000 to 5000 kilovolts per microsecond and a voltage waveform width of between 1 to 12 microseconds. In addition, like positive pulse train 30 previously discussed with respect to FIGS. 2 and 3A-3B, each positive pulse train 60 in FIG. 4A generates positive ions. Similarly, like negative pulse train 32 previously discussed with respect to FIGS. 2 and 3A-3B, each negative pulse train 80 in FIG. 4B generates negative ions.

FIG. 5A discloses a micro-pulse ionizer 120 that uses a wire emitter 122, a reference electrode 124, a power supply 126 disposed to provide at least one voltage-alternating pulse train pair 128, a gas source 130 disposed to provide a flow of gas (not shown), an ion balance circuit 132, an ion balance electrode 134, a spark surge suppressor circuit and corona activity circuit 136. Power supply 126 is electrically coupled to wire emitter 122 and a common reference bus, such as ground 139, and is disposed to output pulse train pair 128 to wire emitter 122 during operation. Pulse train pair 128 includes a serial sequence of pulse trains. Each pulse train has a polarity that is opposite from the polarity of the other pulse train in voltage-alternating pulse train pair 128. In one example, pulse train pair 128 and its pair of pulse trains may be respectively disposed to have the same function and characteristics previously described above for pulse train pair 18, pulse train 60 and pulse train 80.

Emitter 122, reference electrode 124 and gas source 130 may be implemented to have the same structure and function as described above with respect to emitter 12, reference electrode 14, and gas source 20. Power supply 126, ion balance circuit 132, ion balance electrode 134, and spark surge suppressor 136 may be implemented to have the same respective functions as power supply 16, ion balance circuit 24, ion balance electrode 26 and spark surge suppressor and corona activity circuit 28 previously disclosed above but are shown in FIG. 5A to have a particular circuit structure.

Referring to FIGS. 5A and 5B, power supply 126 includes a timer circuit 138 that generates a set of low voltage pulses 140 that each have a relatively short pulse duration 144, a drive circuit 142 that is disposed to receive set of pulses 140 and a primary damping circuit 146. Drive circuit 142 includes a D-Type flip-flop circuit 148, named "dual delay circuit", that has dual inverted outputs; a switching circuit 150; and transistors 152 and 154. A set of pulses 140 are further illustrated in FIG. 5B. Timer circuit 138 and drive circuit 142 are collectively referred to as a pulse drive circuit 141 in this disclosure. Timer circuit 138 includes a timer IC 155, a diode 156, a resistor 158, a capacitor 160, and a resistor 162. Timer IC 155 may be implemented by using any configurable general purpose timer, such as model number LMC555, which is available from National Semiconductor of Santa Clara, Calif.

Timer IC 155 is an integrated circuit disposed to provide a configurable clock signal through a clock output 163. In this embodiment, these clock signals are used as pulses 140. Diode 156, resistor 158 and capacitor 160 establish the pulse duration 144 for pulse 140 (see FIGS. 4 and 5B). Resistor 162 and capacitor 160 set the repetition rate for each pulse 140. The repetition rate is equal to the inverse of pulse period 143. In the embodiment shown, diode 156 may be implemented using a diode having a marking code of 1N4248, while resistors 158 and 162, and capacitor 160 have the following respective values: 1500 ohms, 240K ohms, and 0.01 μF (microfarads). The use of LMC555, the configuration of timer circuit 138, and the values of the passive elements disclosed herein are not intended to be limiting in any way. Any timer circuit 138 may be used as long as it can provide the type of pulses, such as pulse 140 described herein. Transistors 152 and 154 are implemented using n-channel MOSFETs transistors although the use of MOSFET-type transistors is not intended to limit the invention in any way. The term low voltage is any voltage suitable for use with semiconductor components of the type described herein. Such semiconductor component voltages currently range in magnitude from 5 or 12, whether positive or negative, although in the embodiment disclosed herein positive low voltages of 5 and 12 volts are used.

Dual delay circuit 148 is in the form of a D-type flip-flop that has two outputs which are inverted relative to each other. Dual delay circuit 148 may be implemented by using model number MM74C74 from Fairchild Semiconductor of San Jose, Calif. Dual delay circuit 148 is configured to provide two clock signals to switching circuit 150. Switching circuit 150 may be implemented by using a commonly known integrated circuit that provides four dual input AND gates arranged in the manner shown, such as model number MC14081B, available from On Semiconductor Corporation of Phoenix, Ariz.

Dual delay circuit 148 and switching circuit 150 alternately switch each pulse 140 between transistors 152 and 154. Drive circuit 142 receives each pulse 140, and routes each pulse 140 to clock input 161 from dual delay circuit 148 and to an input from each AND gate receive. The first output Q from dual delay circuit 148 is coupled to inputs 165 from two of the AND gates, and the second output (inverted Q) from dual delay circuit 148 is coupled to inputs 167 from the other two of the AND gates, and routed to the data pin of the switching circuit 148. The preset and clear pins are coupled to a 12 volt source.

During the operation of power supply 126, and for each pulse train generated, pulse drive circuit 141 enters a charging stage by causing a current to flow through one half of a primary coil 164 of high voltage transformer 166 for a selected duration. This time duration during which current passes through one half of primary coil 164 is set by and is approximately equivalent to pulse duration 144 of pulse 140. Dual delay circuit 148 and switching circuit 150 alternately switch each pulse 140 between transistors 152 and 154. Power supply 126 generates the asymmetrical waveforms of a positive pulse train, such as positive pulse train 30 or 60 in FIG. 2 or 4A, respectively, when the gate of transistor 152, receives pulse 140 during the charging stage, causing current to flow from a center tap 165 of primary coil 164 and through primary coil end 169, which produces a relatively small negative voltage waveform across one half of primary coil 164 and stores energy in primary coil 164 and in the air spaces and ferrite (if included) of high voltage transformer 166. Through its turns ratio, transformer 166 magnifies this small negative voltage waveform and produces a magnified negative voltage waveform across secondary coil 170. This magnified negative voltage waveform is ultimately received by wire emitter 122 as a non-ionizing negative voltage waveform that forms a portion of a positive pulse train, such as non-ionizing negative voltage waveform 62 and positive pulse train 60 in FIG. 4A, respectively.

The stored energy produces a large positive pulse of voltage when the duration 144 of short pulse 140 expires, such as when trailing edge 145 of pulse 140 is reached, turning off transistor 152 abruptly and producing the large positive pulse of voltage (not shown) across primary coil 164. Transformer 166 magnifies this large positive pulse of voltage and generates across secondary coil 170 a larger magnified ionizing waveform having a positive polarity. This large magnified voltage waveform is ultimately received by wire emitter 122 as an ionizing positive voltage waveform that forms a portion of a positive pulse train, such as ionizing positive voltage waveform 64 and positive pulse train 60 in FIG. 4A, respectively. Ionizing positive voltage waveform 64 is followed by smaller waveforms that oscillate between different polarities and with decreasing voltage amplitudes over time. The voltage amplitudes from these subsequent waveforms do not reach an ionizing voltage and are thus, non-ionizing voltage waveforms. These subsequent waveforms are caused by circuit resonance and can be controlled, eliminated or reduced by using primary damping circuit 146.

Power supply 126 generates the asymmetrical voltage waveforms for a negative pulse train, such as pulse train 32 or 80 in FIG. 2 or 4B, in a manner similar to the generation of a positive pulse train as described immediately above. Power supply 126, however, generates these asymmetrical waveforms for a negative pulse train when dual delay circuit and switching circuit 150 route a pulse 140 to the gate of transistor 154, which causes pulse drive circuit 141 to enter into a charging stage. During this charging stage, transistor 154 causes a current to flow through center tap 165 and primary coil end 171 for a given duration. In the embodiment shown in FIG. 5A, this given duration during which current passes through primary coil 164 is set by and is approximately equivalent to pulse duration 144.

The current flowing through center tap 165 and primary coil end 171 produces a relatively small negative voltage pulse across one half of primary coil 164 and stores energy in primary coil 165 and in the air spaces and ferrite (if included) of high voltage transformer 166. The direction of the current flow through the half portion primary coil 164 bounded by center tap 165 and primary coil end 171 during this charging stage is opposite from the direction of the current flow through the other half portion primary coil 164, which is bounded by center tap 165 and primary coil end 169 used to generate a positive pulse train. Moreover, both of these half portions of primary coil 164 are wound in the same direction. Through its turns ration, transformer 166 magnifies this small negative voltage waveform and produces a magnified positive voltage waveform across secondary coil 170. This magnified positive voltage waveform is ultimately received by wire emitter 122 as the non-ionizing waveform of an asymmetrical voltage waveform that forms a portion of negative pulse train, such as non-ionizing positive voltage waveform 82 and negative pulse train 80 in FIG. 4B, respectively.

The stored energy produces a large negative pulse of voltage when pulse duration 144 of short pulse 140 expires, such as when trailing edge 145 of pulse 140 is reached, turning off transistor 152 abruptly and producing the large negative pulse of voltage (not shown) across primary coil 164. Transformer 166 magnifies this large negative pulse of voltage and generates across secondary coil 170 a larger magnified ionizing waveform having a negative polarity. This large magnified voltage waveform is ultimately received by wire emitter 122 as the ionizing negative voltage waveform of an asymmetrical voltage waveform that forms a portion of a negative pulse train, such as ionizing negative voltage waveform 84 and negative pulse train 80 in FIG. 4B, respectively. Ionizing negative voltage waveform 84 is followed by smaller waveforms that oscillate between different polarities and with decreasing voltage amplitudes over time. The voltage amplitudes from these subsequent waveforms do not reach an ionizing voltage and are thus, non-ionizing voltage waveforms. These subsequent waveforms are causing by circuit resonance and can be controlled, eliminated or reduced by using primary damping circuit 146.

High voltage transformer 166 is disposed to have a turns ratio of between 50 to 1 and 5000 to 1 on secondary coil 170 and primary coil 164. When measured from a power supply output 168, and when power supply 126 is configured as taught within the scope and spirit of this disclosure, transistor 154 causes the production of a negative pulse train, while transistor 152 causes the production of a positive pulse train, which collectively form a voltage-alternating pulse train pair that are ultimately received by emitter 122 and by reference electrode 124 through ground 137, producing by corona discharge a bipolar ion cloud, such as bipolar ion cloud 40 in FIG. 1. These positive and negative pulse trains have the same structure and function as positive and negative pulse trains 60 and 80 previously disclosed above in FIGS. 4A-4B, which respectively include a set of asymmetric waveforms, such as non-ionizing and ionizing voltage waveforms 62-64, and 82-84.

The maximum voltage amplitude of the ionizing waveform, such as ionizing waveform 64 or 84, for each pulse train produced at power supply output 168, is set according to the following variables:

the turns ratio of high voltage transformer 166;

the primary coil inductance of high voltage transformer 164;

the pulse duration 144;

the input DC voltage 172 at the node 174 between resistor 176 and capacitor 178;

the primary damping circuit 146, which includes resistor 180 and capacitor 182; and if ion balance circuit 132 is included, the impedance between transistor 154 and ground 137, which in the example shown in FIG. 5A is the resistance across the drain and source of transistor 177.

In accordance with the embodiment of the present invention shown in FIG. 5A:

the turns ratio of high voltage transformer 166 can range between 50 to 1 to 5000 to 1 for the secondary coil and primary coil;

the primary coil inductance of high voltage transformer 164 is approximately 48 μH (microhenries) with each half portion approximately 14 μH;

the pulse duration 144 of pulse 140 can range between one microsecond to 24 microseconds;

resistor 176 and capacitor 178 are 1 to 100 ohms and 0.1 pF (picofarads), respectively; and the resistance across the drain and source of transistor 177 can range from about 005 to 10 Ohms.

The inductance of primary coil 164, the capacitive load of primary damping circuit 146, which is determined by resistor 180 and capacitor 182, and the capacitive load seen by power supply output 168, which in the example shown includes the capacitive load of wire emitter 122 and reference electrode 124, determine the wave shape of the serial asymmetrical waveforms, such as non-ionizing and ionizing waveforms 62-64 or non-ionizing and ionizing waveforms 82-84, previously discussed above with respect to FIGS. 4A-4B. These sequential asymmetrical waveforms comprise a pulse train, such as pulse train 60 or 80, and are provided by power supply 126 at power supply output 168. In FIG. 5A, the inductance of primary coil 164 may be selected to be in the range of 10 to 100 μH and the load capacitance may be selected in the range of 3 to 60 pF. All values and model numbers of the circuit elements disclosed herein are not intended to limit the various embodiments disclosed herein. The actual values used will vary depending upon the dimensions and type of ionizer designed.

Pulse trains generated by power supply 126 are disposed to have a relatively high slew rate, and, positive and negative pulse trains may be produced in a repeating sequential fashion by power supply 126 by using a relatively small-footprint high voltage transformer that does not include use multipliers, rectifiers, summing blocks or any combination of these components. Pulse repetition rate of each pulse train pair may be adjusted according to the gas flow used the distance of the target location containing the device selected for neutralization, the concentration of ions desired at the target location, or any combinations of these factors.

Ion balance control circuit 132 in FIG. 5A includes transistor 177, ion balance electrode 134, resistor 184, resistor 186, and variable resistor 188, sometimes referred to as a potentiometer, and capacitor 190. Through transistor 177, capacitor 190, and potentiometer 192, ion balance control circuit 132 is also coupled to ground 137 as shown. Resistors 184 and 186 produce a voltage at node 192 when ions flow past electrode 134. This voltage is seen by the gate of transistor 177, causing transistor 177 to change the resistance of transistor 177 across its source and drain. A small amount of bias current is added to the gate of transistor 177 by resistor 192 to compensate for the turn-on bias of transistor 177. Capacitor 190 filters noise from pulses which may affect ion balance signal produced at node 192, while resistor 188 can be set to provide ion flow balance, such as zero, at the ion balance electrode or possibly at target object or target location, such as target location 42 in FIG. 1.

As an example, if for any reason (changes in ambient conditions, emitters contamination or erosion and the like) ion flow from micro-pulse bipolar corona ionizer 120 begins to generate more positive then negative ions, ion balance electrode 134 will acquire a positive charge. This positive charge creates a current flow across resistors 184, 186, and 188, which increases the voltage at node 192 and at the gate of transistor 177, and reduces the resistance across the source and drain of transistor 177. Reducing the resistance across the source and drain of transistor 177, increases the maximum voltage amplitude of the ionizing waveform of the negative pulse train, such as ionizing waveform 84 and negative pulse train 80 in FIG. 4B, for the pulse train pair created by power supply 126. Increasing the maximum voltage amplitude of the ionizing waveform of the negative pulse train, increases the ion balance towards negative ions. As this ion balance tilts towards negative ions, the positive voltage acquired by electrode 134 will begin to decrease, which in turn will decrease the voltage at node 192 that is seen by the gate of transistor 177 until the positive charge generated at ion balance electrode 134 is sufficiently reduced so that the ion balance at the target location previously selected is restored to approximately zero or to another preselected value.

Similarly, if ion flow across electrode 134 creates a negative voltage, node 192 acquires a reduced voltage or even a negative voltage, decreasing the voltage seen by the gate of transistor 177, which raises the resistance of transistor 177 across its drain and source. This reduces the maximum voltage amplitude of the ionizing waveform from the negative pulse train, which in turn, reduces the production of negative ions until the voltage or charge at electrode 134 is sufficiently increased so that the ion balance at the target location previously selected is restored to approximately zero or to another preselected value.

Spark surge suppressor and corona activity circuit 136 provides spark surge suppression and corona activity indicator functions. Diodes 194 and 196, and capacitor 198 provide the spark surge suppression function. If a voltage spark occurs through reference electrode 124, diode 194 shunts any resulting negative current through ground 137, thus protecting the base of transistor 200. Any positive spark surge current is shunted to ground 137 through diode 196 and capacitor 198.

Spark surge suppressor and corona activity circuit 136 provides the corona activity indicator function by using an electrode, such as reference electrode 124, to receive ion current from wire emitter 122 and any currents from induced electrical corona noise signals which flow from to reference electrode 124 across the space separating reference electrode from wire emitter 122. These currents are converted to voltage by inductor 202, rectified by diode 196 and filtered by capacitor 198, which collectively results in a voltage at node 204 and at the base of transistor 200. A fluctuation in voltage at node 204 causes the voltage at the collector of transistor 200 to fluctuate in approximate proportion to the voltage at node 204. Resistor 206 is coupled to the collector and to a 12 volt DC positive voltage and functions as a pull-down resistor. The anode end of LED 208 is coupled to the collector of transistor, while the cathode end of light emitting diode (LED) 208 is coupled to ground. A fluctuation of the voltage at the collector of transistor 200 causes LED 208 to flash or fluctuate as a function of the ion current generated by micro-pulse bipolar ionizer 120. In conjunction with or as an alternative, the voltage at the collector of transistor 200 may be sampled or used as an interrupt signal 210 by a microprocessor or equivalent (not shown) to enable the microprocessor to determine the state of ion generation.

Figure 6A:
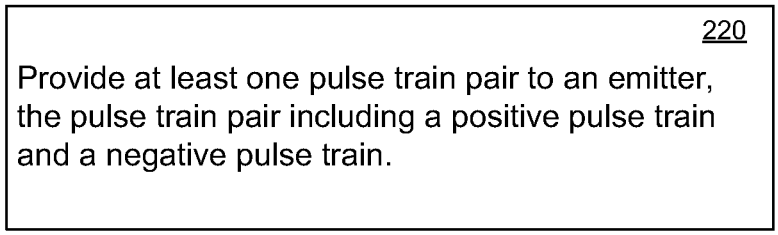
FIG. 6A illustrates a method for creating bipolar ions by corona discharge by providing at least one pulse train pair to an emitter in accordance with yet another embodiment of the present invention.

FIG. 6A illustrates a method for creating bipolar ions by corona discharge by providing at least one pulse train pair to an emitter in accordance with yet another embodiment of the present invention. At 220, at least one pulse train pair is provided to an emitter of an ionizer, such as pulse train pair 18, emitter 12 and ionizer 10 in FIG. 1. The pulse train pair is disposed to include a positive pulse train and a negative pulse train that alternate in sequence, such as positive and negative pulse trains 30 and 32 in FIG. 2. The positive pulse train includes an ionizing positive voltage waveform and the negative pulse train including an ionizing negative voltage waveform. These ionizing positive and negative voltage waveforms alternately create voltage gradients across the emitter and the reference electrode, generating by corona discharge an ion cloud that includes positive and negative ions.

Figure 6B:
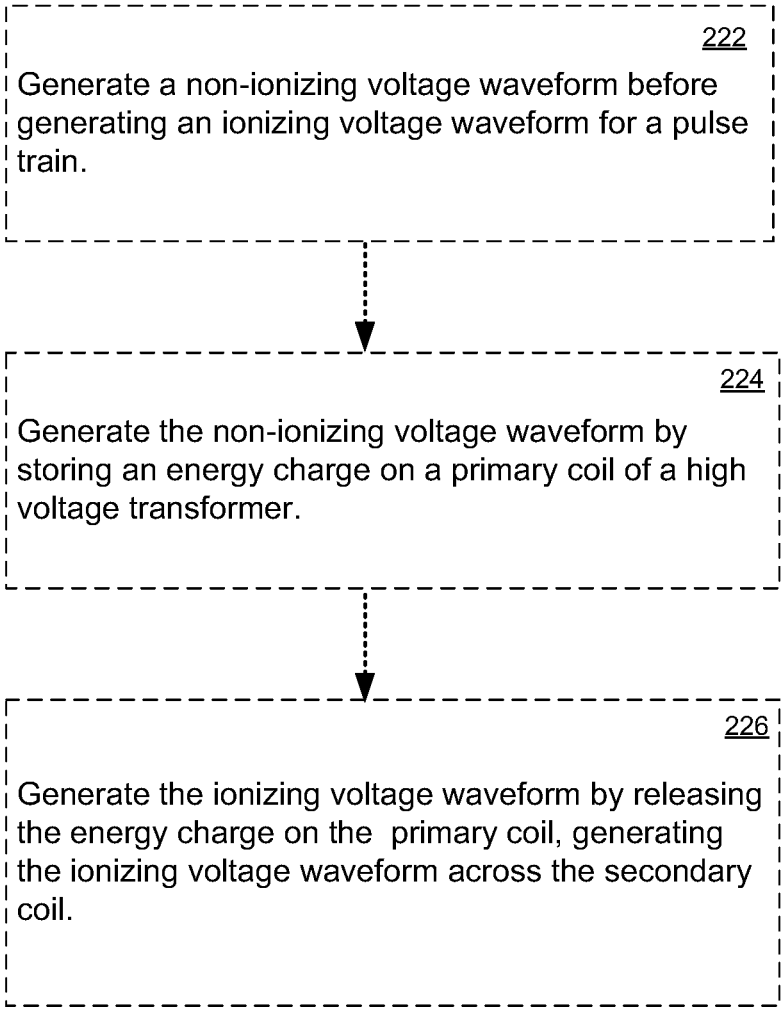
FIG. 6B illustrates optional additional steps to the method disclosed in FIG. 6A above in accordance with an alternative embodiment of the present invention.

FIG. 6B illustrates optional additional steps to the method disclosed in FIG. 6A above in accordance with an alternative embodiment of the present invention.

At 222, a non-ionizing voltage waveform is generated before the ionizing waveform is generated for a pulse train. For example (not shown), a non-ionizing negative voltage waveform may be generated before generating the ionizing positive waveform for a positive pulse train, such as positive pulse train 60 in FIG. 4A. Similarly, a non-ionizing positive voltage waveform may be generated before generating the ionizing negative waveform for a negative pulse train, such as negative pulse train 80 in FIG. 4B.

In accordance with yet a further alternative embodiment of the present invention disclosed in FIG. 6B, at 224, the non-ionizing voltage waveform is generated on a secondary coil of a high voltage transformer by storing energy on a primary coil of the transformer, such as secondary coil 170, high voltage transformer 166, and primary coil 164 in FIG. 5A, respectively. At 226, a voltage across this primary coil is generated when the energy charge is released, generating an ionizing voltage waveform across the secondary coil.

While the present invention has been described in particular embodiments, it should be appreciated that the present invention should not be construed as limited by such embodiments. Rather, the present invention should be construed according to the claims below.

I claim:

1. An apparatus for generating ions within a space separating an emitter and a reference electrode, the apparatus comprising:

an emitter;

a reference electrode;

a power supply disposed to provide at least one pulse train pair to said emitter, said pulse train pair including a positive pulse train and a negative pulse train that alternate in sequence, and said positive pulse train including an ionizing positive voltage waveform and said negative pulse train including an ionizing negative voltage waveform; and wherein said ionizing positive and negative voltage waveforms alternately create voltage gradients between said emitter and said reference electrode, generating by corona discharge an ion cloud that includes positive and negative ions; and wherein at least one of said pulse trains further includes a first polarity non-ionizing voltage waveform followed by an opposite polarity ionizing voltage waveform.

2. The apparatus of claim 1, wherein said positive pulse train further includes a first non-ionizing negative voltage waveform that occurs before said ionizing positive waveform.

3. The apparatus of claim 2: said power supply includes a transformer having primary coil and a secondary coil, said power supply disposed to generate said first non-ionizing negative voltage waveform on said secondary coil by storing energy on said primary coil, and to generate a voltage across said primary coil when said energy is released, causing the generation of said ionizing positive waveform across said secondary coil.

4. The apparatus of claim 3, wherein said positive pulse train further includes a second non-ionizing negative voltage waveform, said second non-ionizing negative voltage waveform generated by a circuit resonance caused by said voltage.

5. The apparatus of claim 4, further including:

a damping circuit coupled to said transformer and disposed to reduce non-ionizing voltage waveforms that are created by said circuit resonance after said second non-ionizing negative voltage waveform is generated by said circuit resonance.

6. The apparatus of claim 3, further including:

a damping circuit coupled to said transformer and disposed to reduce non-ionizing voltage waveforms that are created by said circuit resonance after said ionizing positive voltage waveform is generated.

7. The apparatus of claim 2, said first non-ionizing negative waveform is disposed with a rise slew rate and a fall slew rate that is less than a rise slew rate and a fall slew rate of said ionizing positive waveform, respectively.

8. The apparatus of claim 1, wherein said power supply includes a primary coil and a secondary coil, said power supply disposed to generate said positive and negative pulse trains alternately on said secondary coil by causing a current to flow through a portion of said primary coil for a first duration and by causing another current to flow through another portion of said primary coil for a second duration after said first duration expires.

9. The apparatus of claim 8, wherein said first and second durations are equal.

10. The apparatus of claim 1:

said power supply includes a primary coil having a first primary coil end, a second primary coil end and a center tap, and a secondary coil that is electrically coupled to said emitter and said reference electrode; and said power supply disposed to generate alternately said positive and negative pulse trains on said secondary coil by alternately causing a first current to flow through said first end and said center tap and a second current to flow through said second end and said center tap.

11. The apparatus of claim 10:

said primary and secondary coils are part of a high voltage step-up transformer, and said secondary coil includes a first secondary coil end that is electrically coupled to said emitter and a second secondary coil end that is electrically coupled to said reference electrode;

said positive pulse train further includes a first non-ionizing negative voltage waveform;

further including a pulse drive circuit disposed to generate said first and second currents for a duration; and wherein said first non-ionizing negative voltage waveform is generated on said secondary coil during said duration, and said ionizing positive waveform is generated on said secondary coil when said duration expires.

12. The apparatus of claim 1, wherein said power supply generates said pulse train pair at a repetition rate in the range of one to 4000 times per second, and uses a duty factor from 0.1 to 1 percent for said pulse train pair.

13. The apparatus of claim 12, further including any combination of the following:

a gas source, and said power supply is disposed with said repetition rate that is a function of a velocity of gas moved by said gas source;

an ion balance circuit, and said power supply is responsive to said ion balance circuit, including by varying an amplitude of said ionizing negative voltage waveform; and a spark surge suppressor and ion activity circuit electrically coupled between said reference electrode and a common reference bus.

14. A method for generating ions within a space separating an emitter and a reference electrode, the method comprising:

providing at least one pulse train pair to said emitter, said pulse train pair including a positive pulse train and a negative pulse train that alternate in sequence, and said positive pulse train including an ionizing positive voltage waveform and said negative pulse train including an ionizing negative voltage waveform; and wherein said ionizing positive and negative voltage waveforms alternately create voltage gradients across said emitter and said reference electrode, generating by corona discharge an ion cloud that includes positive and negative ions; and wherein at least one of said pulse trains further includes a first polarity non-ionizing voltage waveform followed by an opposite polarity ionizing voltage waveform.

15. The method of claim 14 further including: generating a first non-ionizing negative voltage waveform before said ionizing positive waveform is created.

16. The method of claim 15, further including: generating said first non-ionizing negative voltage waveform on a secondary coil of a high voltage transformer by storing energy on a primary coil of said transformer, and generating a voltage across said primary coil when said energy is released, said generating a voltage causing the generation of said ionizing positive waveform across said secondary coil.

17. The method of claim 16, wherein said generating said voltage across said primary coil further causes a circuit resonance within a power supply that includes said primary and secondary coils, said circuit resonance causing the generation of said second non-ionizing waveform; and said positive pulse train further includes said second non-ionizing negative voltage waveform.

18. The method of claim 17, further including: reducing non-ionizing voltage waveforms that are created by said circuit resonance after said second non-ionizing negative voltage waveform is generated.

19. The method of claim 17, further including: reducing non-ionizing voltage waveforms that are created by said circuit resonance after said ionizing positive voltage waveform is generated.

20. The method of claim 14, further including: generating said positive and negative pulse trains alternately on a secondary coil of a transformer by causing a current to flow through a portion of a primary coil of said transformer for a first duration and by causing another current to flow through another portion of said primary coil for a second duration after said first duration expires.

* * * * *